US007628576B2

(12) United States Patent
Glesti et al.

(10) Patent No.: US 7,628,576 B2
(45) Date of Patent: Dec. 8, 2009

(54) METHOD OF MODIFYING A TURBOCOMPRESSOR

(75) Inventors: Daniel Glesti, Niederglatt (CH); Marco Micheli, Wettingen (CH); Thomas Palkovich, Turgi (CH); Wifried Rick, Lauchringen (DE); Sasha Savic, Wettingen (CH)

(73) Assignee: ALSTOM Technology Ltd., Baden (CH)

( * ) Notice: Subject to any disclaimer, the term of this patent is extended or adjusted under 35 U.S.C. 154(b) by 167 days.

(21) Appl. No.: 11/623,408

(22) Filed: Jan. 16, 2007

(65) Prior Publication Data

US 2007/0128024 A1 Jun. 7, 2007

Related U.S. Application Data

(63) Continuation of application No. PCT/EP2005/053378, filed on Jul. 14, 2005.

(30) Foreign Application Priority Data

Jul. 26, 2004 (DE) ..... 10 2004 036 238

(51) Int. Cl.
*F04D 27/00* (2006.01)

(52) U.S. Cl. ..... 415/1; 415/28; 415/912

(58) Field of Classification Search ..... 415/145, 415/912, 27, 28, 29
See application file for complete search history.

(56) References Cited

U.S. PATENT DOCUMENTS

| | | | |
|---|---|---|---|
| 3,031,132 | A | 4/1962 | Davies |
| 5,520,512 | A | 5/1996 | Walker et al. |
| 6,379,112 | B1 | 4/2002 | Montgomery |

FOREIGN PATENT DOCUMENTS

| | | | |
|---|---|---|---|
| DE | 1107887 | | 5/1961 |
| DE | 3313321 | | 10/1984 |
| DE | 3517486 | | 11/1985 |
| DE | 19541192 | | 5/1997 |
| GB | 777955 | | 7/1957 |
| JP | 62195492 | A * | 8/1987 |

OTHER PUBLICATIONS

Search Report for German Patent App. No. 10 2004 036 238.6 (Feb. 10, 2005).
International Search Report for PCT Patent App. No. PCT/EP2005/053378 (Dec. 27, 2005).

* cited by examiner

*Primary Examiner*—Richard Edgar
(74) *Attorney, Agent, or Firm*—Cermak Kenealy Vaidya & Nakajima LLP; Adam J. Cermak

(57) ABSTRACT

In a method of modifying a turbocompressor, the compressor blades are replaced by new compressor blades in such a way that the delivered mass flow of the compressor increases. At the same time, the capacities for blowing off during the start-up are increased.

7 Claims, 1 Drawing Sheet

METHOD OF MODIFYING A TURBOCOMPRESSOR

This application is a Continuation of, and claims priority under 35 U.S.C. § 120 to, International application number PCT/EP2005/053378, filed 14 Jul. 2005, and claims priority under 35 U.S.C. § 119 therethrough to German application number 10 2004 036 238.6, filed 26 Jul. 2004, the entireties of which are incorporated by reference herein.

BACKGROUND OF THE INVENTION

1. Field of the Invention

The invention relates to a method of modifying a turbocompressor, to a turbocompressor modified according to this method, and to the use of the turbocompressor so modified.

2. Brief Description of the Related Art

During the start-up of a turbocompressor, the compressor, on account of the stage kinematics at low speed, is not able to deliver the entire delivery quantity of the volumetric inlet flow against the pressure imposed by the load. It is also problematical at underspeed of a turbocompressor that the volumetric flow in the rear compressor stages turns out to be markedly smaller than corresponds to the design of the cross sections of flow. Thus, on the one hand, the enthalpy build-up is displaced into the front compressor stages, in which there is therefore an increased tendency of the compressor flow to separate. On the other hand, obstruction of the cross sections of flow potentially occurs in the rear compressor stages, which further increases the pressure build-up in the front compressor stages. It is therefore known to arrange blow-off lines at intermediate stages of turbocompressors, these blow-off lines being capable of being shut off. During the acceleration of the turbocompressor, these blow-off lines are opened. Thus some of the mass flow delivered into the front compressor stages is drawn off, and only a partial mass flow is admitted to the rear compressor stages. It is ensured that the axial velocity of the flow in the front compressor stages is high enough in order to prevent a flow separation, whereas the axial velocity in the rear compressor stages does not achieve any critical values.

In the course of the service life of turbocompressors over several years, progress in the fields of aerodynamics and production technology permits improvements in output through the use of modern blades. Use is made of these possibilities by existing turbocompressors, for example of gas turbosets, being retrofitted with improved blades. The effect of such retrofitting with improved blades is an increased volumetric intake flow and thus an increased nominal mass flow of the compressor, thereby also resulting in a higher pressure ratio with an unchanged load, for example a turbine, arranged downstream of the compressor.

SUMMARY OF THE INVENTION

One of numerous aspects of the present invention involves a method of the aforementioned type, and can include a modified compressor which has an increased nominal mass flow can be started up without any problems.

According another aspect of the present invention, the capacity for blowing off compressed or partly compressed fluid can be increased. The capacity is increased, for example, in the same ratio as the volumetric intake flow is increased by the modification of the compressor blades. According to a first exemplary embodiment of the invention, the blow-off capacity is increased by increasing the critical cross section of flow of at least one blow-off line connected to the compressor.

In general, the narrowest cross section of the flow line must be increased in this case. The narrowest cross section is often present in the shut-off member which serves to close and open up the blow-off line. The invention can therefore be realized in a very simple manner by the shut-off member, also called a shut-off valve, being replaced by a shut-off member having an enlarged free cross section.

According to a second exemplary embodiment, additional blow-off lines are arranged. This may be done by existing openings, closed by flange covers, of the compressor casing being opened and by additional blow-off lines being connected to the housing openings produced as a result. Alternatively, additional new casing openings may be incorporated in the compressor casing. In this case, the additional blow-off lines may on the one hand be arranged at a pressure stage of the compressor, at which pressure stage there is already an existing blow-off line. The blow-off capacity at the corresponding pressure stage of the compressor is then increased. However, it is also perfectly possible to arrange the additional blow-off line at a point at which no blow-off line is connected before the modification. A blow-off means is then provided at an additional pressure stage.

Blow-off lines are in general arranged on the compressor in such a way that partly compressed fluid is blown off. For example, the blow-off line branches off between two compressor stages. This ensures that, as mentioned above, when the blow-off line is opened, the mass flow in the front compressor stages is greater than in the rear compressor stages. Furthermore, in one embodiment, if the compressor is connected to a load for compressed fluid, the compressor being arranged upstream of the load, for example a turbine, a blow-off line can be arranged downstream of the compressor and upstream of the load. For example, a blow-off line of a compressor of a gas turboset is arranged downstream of the compressor and upstream of a first combustion chamber of the gas turboset. During the start-up of the compressor, the back pressure against which the compressor has to work is reduced and thus the risk of separation is decreased by opening a blow-off line arranged in such a way.

These embodiments may be combined with one another in any desired manner and may be used to complement one another.

The invention is suitable for converting a turbocompressor and for increasing its output, which turbocompressor, for example, is the compressor of a gas turboset. The gas turboset in turn, in another exemplary embodiment of the invention, is an integral part of a power plant, for example a combined-cycle plant.

Further embodiments of the invention will become apparent to the person skilled in the art in the light of the exemplary embodiments below.

BRIEF DESCRIPTION OF THE DRAWING

The invention is explained in more detail below with reference to an exemplary embodiment illustrated in the drawing. The single FIG. 1 (including subfigures 1*a* and 1*b*) shows a gas turboset before and after a modification according to the invention of the compressor. The drawing and the exemplary embodiment are in this case to be understood purely by way of example; elements which are not necessary for the understanding of the invention have been omitted.

DETAILED DESCRIPTION OF EXEMPLARY EMBODIMENTS

Figure 1A:
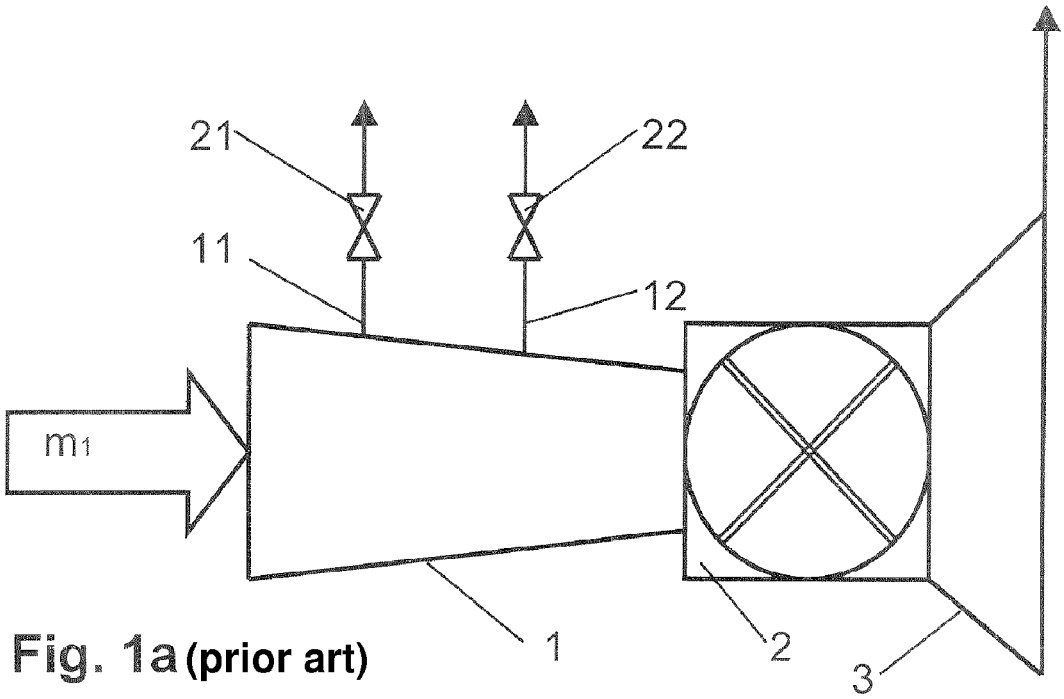
Fig. 1a (prior art)

FIG. 1*a* shows a gas turboset, including a compressor 1, a combustion chamber 2, and a turbine 3, as is readily familiar to the person skilled in the art. During operation of the gas turboset, the compressor 1 draws in a volumetric intake flow or a nominal mass flow $m_1$. This air mass flow is compressed in the compressor 1. A fuel mass flow is burned in the compressed combustion air in the combustion chamber 2, and the hot flue gas produced is expanded in the turbine 3 to perform work. Blow-off lines 11 and 12 with shut-off members 21 and 22 are arranged at the compressor 1. As explained at the beginning, these blow-off lines serve to blow off partly compressed air from the compressor during start-up of the compressor at speeds markedly below the rated speed.

Figure 1B:
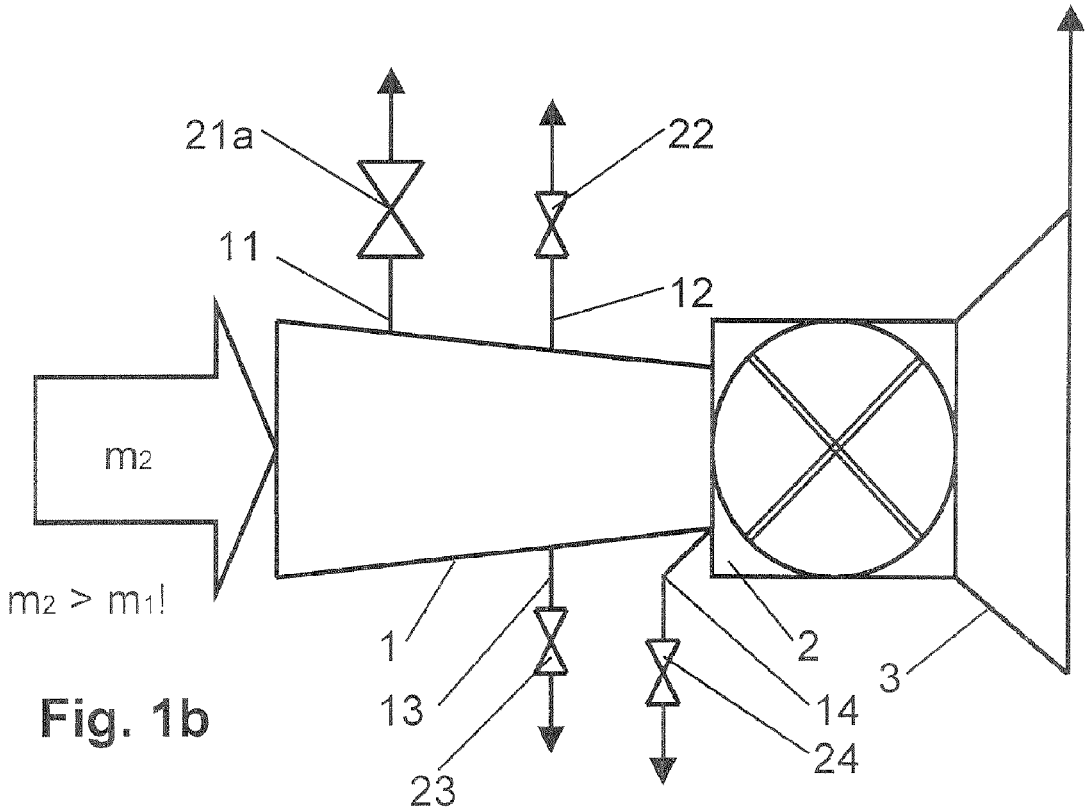

The gas turboset after a modification according to the invention of the compressor 1 is shown in FIG. 1*b*. Due to the provision of improved compressor blades, the volumetric intake flow of the compressor 1 increases, and the compressor accordingly delivers a nominal mass flow $m_2$ which is greater than the nominal mass flow m1 before the conversion. The result of the increase in the nominal mass flow is that the air mass flow blown off during the start-up is proportionally smaller than before the conversion to new blades. Despite the blow-off of compressor air, this potentially results in the occurrence of flow separations in the front compressor stages and/or of obstruction of the rear compressor stages.

According to the invention, the blow-off capacities of the compressor have now been increased. The blow-off valve 21 of the blow-off line 11 is replaced by a blow-off valve 21*a* having an enlarged cross section of flow. Furthermore, a new blow-off line 13 having a blow-off valve 23 has just been arranged. The blow-off line 13 can branch off at a pressure stage of the compressor at which another blow-off line is already arranged, as shown in the figure. However, the blow-off line 13 may also be readily arranged at a point of the compressor at which no blow-off line was arranged previously. Furthermore, the blow-off line 13 may adjoin an opening already existing, but previously closed by a flange cover, of the casing of the compressor 1; but if need be, a new opening may also have been incorporated in the casing, the new blow-off line 13 then adjoining this new opening. In addition, a further blow-off line 14 with a blow-off valve 24 adjoins downstream of the compressor 1 and upstream of the combustion chamber 2. By blow-off at this point, the overall pressure ratio of the compressor is reduced, which further reduces the risk of separation. Due to this modification, a substantially larger mass flow overall can be passed through the blow-off lines 11, 12, 13, and 14.

LIST OF DESIGNATIONS

1 Compressor, turbocompressor
2 Combustion chamber
3 Turbine
11 Blow-off line
12 Blow-off line
13 Blow-off line
14 Blow-off line
21 Shut-off member, blow-off valve
21*a* Shut-off member, blow-off valve
22 Shut-off member, blow-off valve
23 Shut-off member, blow-off valve
24 Shut-off member, blow-off valve
$m_1$ Mass intake flow before the modification
$m_2$ Mass intake flow after the modification While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A method of modifying a turbocompressor, comprising:
removing first blades of the turbocompressor;
replacing said first blades with second blades, as a result of which replacing the volumetric intake flow of the compressor is increased at the same speed and the same pressure ratio; and
increasing the capacity for blowing off compressed or partly compressed fluid.

2. The method as claimed in claim 1, wherein increasing the blow-off capacity comprises increasing the blow-off capacity in the same ratio as the volumetric intake flow.

3. The method as claimed in claim 1, wherein increasing the blow-off capacity comprises increasing the cross section of flow of at least one blow-off line connected to the turbocompressor.

4. The method as claimed in claim 1, further comprising:
opening at least one existing casing flange of the turbocompressor casing, to produce a casing opening; and
connecting an additional blow-off line to the casing opening.

5. The method as claimed in claim 1, further comprising:
incorporating at least one additional opening in the compressor casing; and
arranging an additional blow-off line at said at least one additional opening.

6. The method as claimed in claim 1, wherein the turbocompressor is arranged upstream of a load, and further comprising:
arranging a blow-off line downstream of the turbocompressor and upstream of the load.

7. The method as claimed in claim 1, wherein the turbocompressor comprises a compressor of a gas turboset having a first combustion chamber, and further comprising:
arranging a blow-off line downstream of the turbocompressor and upstream of the first combustion chamber.

* * * * *